166-308 SR

6/2/87 OR 4,669,546

United States Patent [19]

Jennings, Jr. et al.

[11] Patent Number: 4,669,546

[45] Date of Patent: Jun. 2, 1987

[54] METHOD TO IMPROVE VERTICAL HYDRAULIC FRACTURING IN INCLINED WELLBORES

[75] Inventors: Alfred R. Jennings, Jr., Plano; Malcolm K. Strubhar, Irving, both of Tex.

[73] Assignee: Mobil Oil Corporation, New York, N.Y.

[21] Appl. No.: 815,970

[22] Filed: Jan. 3, 1986

[51] Int. Cl.[4] ..... E21B 43/26

[52] U.S. Cl. ..... 166/308; 166/50

[58] Field of Search ..... 166/308, 271, 280, 297, 166/299, 55, 63, 50

[56] References Cited

U.S. PATENT DOCUMENTS

| | | | |
|---|---|---|---|
| 2,952,319 | 9/1960 | Popham | 166/63 X |
| 3,002,454 | 10/1961 | Chesnut | 166/308 UX |
| 3,058,521 | 10/1962 | Gilbert | 166/308 |
| 3,270,816 | 9/1966 | Staadt | 166/308 X |
| 3,280,913 | 10/1966 | Smith | 166/308 X |
| 3,313,348 | 4/1967 | Huitt et al. | 166/308 X |
| 3,419,070 | 12/1968 | Ernst | 166/308 X |
| 3,712,379 | 1/1973 | Hill | 166/308 X |
| 3,835,928 | 9/1974 | Strubhar et al. | 166/308 |
| 3,878,884 | 4/1975 | Raleigh | 166/308 |
| 4,194,577 | 3/1980 | Vann | 166/297 X |

*Primary Examiner*—Stephen J. Novosad

*Attorney, Agent, or Firm*—A. J. McKillop; M. G. Gilman; C. A. Malone

[57] ABSTRACT

A method for improving vertical hydraulic fracturing of an inclined wellbore through in-line openings in said wellbore. Via this method, the initiation, growth, and propagation of vertical fractures are controlled.

17 Claims, 2 Drawing Figures

METHOD TO IMPROVE VERTICAL HYDRAULIC FRACTURING IN INCLINED WELLBORES

FIELD OF THE INVENTION

This invention is directed to a method for controlling the initiation, growth, and propagation of vertical fractures in a deviated well penetrating a subterranean formation.

BACKGROUND OF THE INVENTION

Various methods are recognized in the prior art for forming both horizontal and vertical fractures in subterranean formations by applying hydraulic pressure to the formation. It is generally considered that, at depth, vertical fractures are formed in most formations when a sufficiently high hydraulic pressure is applied to fracture the formation. At shallower depths it is recognized that horizontal fractures may be formed in formations if fracturing pressures are greater than the overburden pressure. The overburden pressure is normally on the order of 1 psi per foot of overburden.

With the continued search for hydrocarbon production in offshore locations, the need for stimulation by hydraulic fracturing will likely increase. For economic reasons, often several wells are drilled from a single platform resulting in wells with inclined wellbores. When hydraulic fracturing is applied to these wells, fracture initiation and propagation will occur according to the influence of the in-situ rock stresses with the fracture generally following the path of least resistance, perpendicular to the least principal stress. In many inclined wellbore configurations, hydraulic fracturing may result in a fracture pattern different than that planned for optimum stimulation of the well. Often, the fracture pattern results in multiple short vertical fractures.

Therefore, what is needed is a method to control the initiation, growth, and propagation of a fracture pattern in a deviated well to obtain a single, extensive fracture which penetrates a subterranean formation.

SUMMARY OF THE INVENTION

This invention is directed to a method for creating vertical fractures in an inclined or deviated well which penetrates a subterranean formation. In the practice of this invention, in-line openings are placed within the wellbore casing on the low side of said wellbore casing. Said openings are sufficient to create a vertical fracture having a desired horizontal width in said formation during hydraulic fracturing.

Thereafter, hydraulic pressure of a force sufficient to fracture said formation is directed into the well into the area of said in-line openings. As a result of said force being longitudinally directed through said in-line openings, a fracture is initiated uniformly so that early fracture growth is controlled primarily by near wellbore geometric effects. Continued fracture growth moves continually and smoothly through a transition from the early geometric domination to conditions determined by in-situ stress. This will assure propagation of a single, extensive fracture rather than multiple short fractures, no matter the direction of the inclined wellbore compared to the preferred fracture azimuth.

It is therefore an object of this invention to control the initiation, growth, and propagation of a vertical fracture in the area near a deviated wellbore.

It is another object of this invention to insure the initiation of a longitudinal fracture along the low side of a deviated wellbore by in-line openings.

It is a yet another object of this invention to create a more effective fracture system for proppant transport.

It is a still yet further object of this invention to create a more effective system for formation draining after hydraulic fracturing.

DESCRIPTION OF THE PREFERRED EMBODIMENTS

Figure 1:
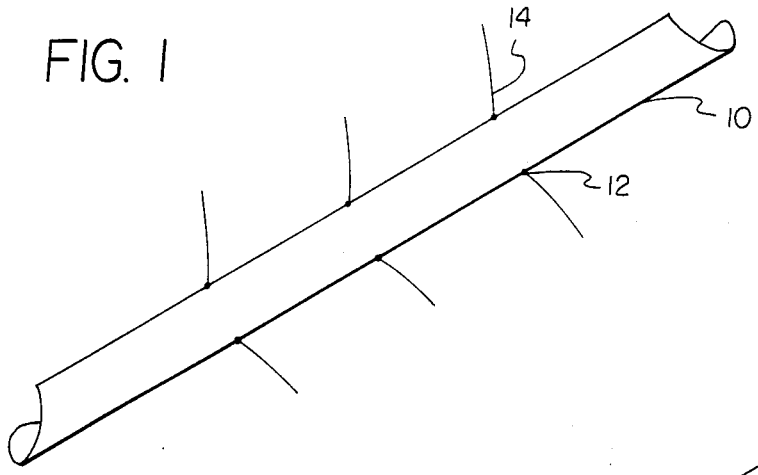
FIG. 1 is a schematic view of an inclined or deviated wellbore showing multiple short length fractures.
Figure 2:
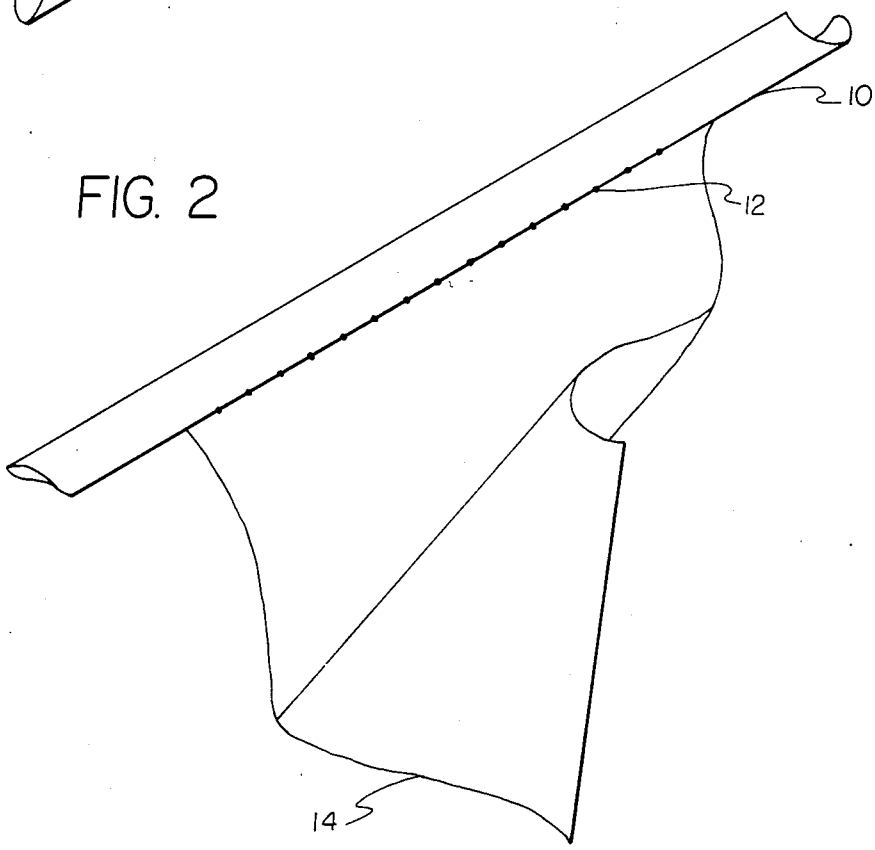
FIG. 2 is a schematic view of an inclined wellbore showing initiation of a fracture along the wellbore which subsequently orients according to earth stresses.

In the practice of this invention, an inclined or deviated wellbore 10 is conditioned to contain in-line openings as shown in FIG. 2. These in-line openings can be obtained by notching or perforating such as with a "through tubing" perforating gun equipped with a magnetic decentralizer. Schlumberger's $2\frac{1}{2}$ inch Enerjet is an example of a "through tubing" gun (not shown) which can be used. This gun can be purchased from Schlumberger, Inc., which is located at various field office locations worldwide.

This gun is loaded in relationship with the decentralizer (not shown) to allow zero degree or in line phasing of the perforations 12 on the low side of the wellbore as shown in FIG. 2. Perforations 12 are placed in wellbore 10 in the density of at least four shots per foot via said gun. Of course, in lieu of perforations, wellbore 10 can be notched on its low side in an in-line manner.

After wellbore 10 has been conditioned to contain the in-line openings, hydraulic fracturing is commenced using pressures, rates, and volumes necessary to achieve the desired fracture geometry. One method for creating multiple vertical fractures in a deviated well by hydraulic fracturing is disclosed by Strubhar et al. in U.S. Pat. No. 3,835,928. This patent issued Sept. 17, 1974 and is hereby incorporated by reference. The placement of said zero degree or in-line phasing on the low side of said well, however, insures the initiation of a single longitudinal fracture along the wellbore which creates a vertical fracture 14 as shown in FIG. 2. As propagation continues, the exact shape of the fracture will depend on the relation of the wellbore direction to the preferred fracture orientation. One configuration might be as shown in FIG. 2. Upon leaving the in-line opening in wellbore 10, a primary diagonal fracture is initiated causing a vertical fracture to be downwardly and outwardly directed. Initiation of the longitudinal fracture along the wellbore has been shown in existing rock mechanics model studies. As a result of said force being longitudinally directed through said in-line openings, a fracture is initiated uniformly so that early fracture growth is controlled primarily by near wellbore geometric effects. Continued fracture growth moves continually and smoothly through a transition from the early geometric domination to conditions determined by in-situ stress. This will assure propagation of a single, extensive fracture rather than multiple short fractures, no matter the direction of the inclined wellbore compared to the preferred fracture azimuth.

After the fracture leaves the wellbore 10, in-situ rock stresses determine the preferred orientation and direction of propagation. Utilization of this method results in a more effective created fracture system for proppant transport. Such utilization also results in more effective formation drainage after the fracturing treatment.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

We claim:

1. A method for creating vertical hydraulic fractures in an inclined wellbore, having a casing therein, which penetrates a hydrocarbonaceous formation comprising:

(a) placing at least one in-line opening within the wellbore casing on the low side of said wellbore casing which opening is sufficient to allow the creation of at least one vertical fracture in said formation; and (b) generating hydraulically a force sufficient to vertically fracture said formation in the area of said in-line opening, as a result of said force being longitudinally directed through said in-line opening and thereafter vertically downwardly and thereafter vertically upwardly due to in-situ rock stresses.

2. The method as recited in claim 1 where in step (a) said in-line opening comprises at least one perforation.

3. The method as recited in claim 1 where in step (a) said in-line opening comprises at least one notch.

4. The method as recited in claim 1 where in step (a) said in-line opening comprises at least two perforations with zero degree phasing.

5. The method as recited in claim 1 where in step (a) said in-line opening comprises perforations which are placed in-line at the rate of at least four perforations per foot.

6. The method as recited in claim 1 where after step (b) hydrocarbonaceous fluids are produced from said wellbore.

7. A method for creating vertical hydraulic fractures in an inclined wellbore, having a casing therein, which penetrates a formation comprising:

(a) placing at least one in-line opening within the wellbore casing on the low side of said wellbore casing which opening is sufficient to allow the creation of at least one vertical fracture in said formation; and (b) generating hydraulically a force sufficient to vertically fracture said formation in the area of said in-line opening, as a result of said force being longitudinally directed through said in-line opening and thereafter vertically downwardly and thereafter vertically upwardly due to in-situ rock stresses.

8. The method as recited in claim 7 where in step (a) said in-line opening comprises at least one perforation.

9. The method as recited in claim 7 where in step (a) said in-line opening comprises at least one notch.

10. The method as recited in claim 7 where in step (a) said in-line opening comprises at least two perforations with zero degree phasing.

11. The method as recited in claim 7 where in step (a) said in-line opening comprises perforations which are placed in-line at the rate of at least four perforations per foot.

12. A method for hydraulically fracturing an inclined or deviated wellbore, having a casing therein, which penetrates a hydrocarbonaceous formation comprising:

(a) placing at least one in-line opening within the wellbore casing on the low side of said wellbore casing which opening is sufficient to allow the creation of at least one substantially vertical fracture in said formation; and (b) generating hydraulically a force sufficient to vertically fracture said formation in the area of said in-line opening, as a result of said force being longitudinally directed through said in-line opening and thereafter outwardly which results in a single, downwardly and extensive fracture without regard to the direction of said inclined wellbore compared to the preferred fracture azimuth.

13. The method as recited in claim 12 where in step (a) said in-line opening comprises at least one perforation.

14. The method as recited in claim 12 where in step (a) said in-line opening comprises at least one notch.

15. The method as recited in claim 12 where in step (a) said in-line opening comprises at least two perforations with zero degree phasing.

16. The method as recited in claim 12 where in step (a) said in-line opening comprises perforations which are placed in-line at the rate of at least four perforations per foot.

17. The method as recited in claim 12 where after step (b) hydrocarbonaceous fluids are produced from said wellbore.

* * * * *